US005595111A

United States Patent [19]

Michael et al.

[11] Patent Number: 5,595,111

[45] Date of Patent: Jan. 21, 1997

[54] PRESS INSTALLATION COMPRISING LONGITUDINAL TRAVERSES

[75] Inventors: Wolfgang Michael, Göppingen; Kurt Strommer, Kuchen; Hans Hofele, Göppingen, all of Germany

[73] Assignee: L. Schuler GmbH, Germany

[21] Appl. No.: 80,784

[22] Filed: Jun. 24, 1993

[30] Foreign Application Priority Data

Jun. 27, 1992 [DE] Germany ..... 42 21 143.3

[51] Int. Cl.[6] ..... B30B 15/30; B30B 15/04

[52] U.S. Cl. ..... 100/207; 72/405.01; 72/455; 100/214

[58] Field of Search ..... 72/405, 455; 100/193, 100/207, 208, 214, 282

[56] References Cited

U.S. PATENT DOCUMENTS

| | | | |
|---|---|---|---|
| 1,327,815 | 1/1920 | Francis | 100/193 |
| 3,683,665 | 8/1972 | Bradlee | 72/405 |
| 3,724,364 | 4/1973 | Münch et al. | 100/214 |
| 3,779,155 | 12/1973 | Ohno | 100/208 X |
| 4,089,205 | 5/1978 | Mizumoto et al. | 72/455 X |
| 4,137,840 | 2/1979 | Kubota | 100/282 X |
| 5,012,665 | 5/1991 | Brandstetter | 72/405 |

FOREIGN PATENT DOCUMENTS

| | | | |
|---|---|---|---|
| 2075213 | 10/1971 | France . | |
| 3143690 | 9/1982 | Germany . | |
| 3322377 | 1/1985 | Germany . | |
| 3328631 | 2/1985 | Germany . | |
| 58-93599 | 6/1983 | Japan | 100/207 |
| 58-212900 | 12/1983 | Japan | 100/207 |
| 1-157800 | 6/1989 | Japan | 100/207 |
| 4414 | 1/1892 | Switzerland | 100/193 |
| 701 | 3/1864 | United Kingdom | 100/193 |

*Primary Examiner*—Stephen F. Gerrity
*Attorney, Agent, or Firm*—Evenson, McKeown, Edwards & Lenahan, P.L.L.C.

[57] ABSTRACT

A transfer press or similar press installation is provided with a press frame including press supports, a press bed, and headpieces, these press parts being rigidly connected with one another by turnbuckles. The press installation includes slides and a transfer device, which are movable by driving devices. Longitudinal traverses are provided which extend along the length of at least the working stages. The press supports are arranged in front of and behind the working stages, and the longitudinal traverses are placed on these press supports. The longitudinal traverses are provided with guides which interact with guides mounted on the slides for the bearing of the slides which move up and down. As a result, a stable and cost-effective construction of the press installation is achieved while supports in the central working areas are omitted.

1 Claim, 2 Drawing Sheets

FIG. 1
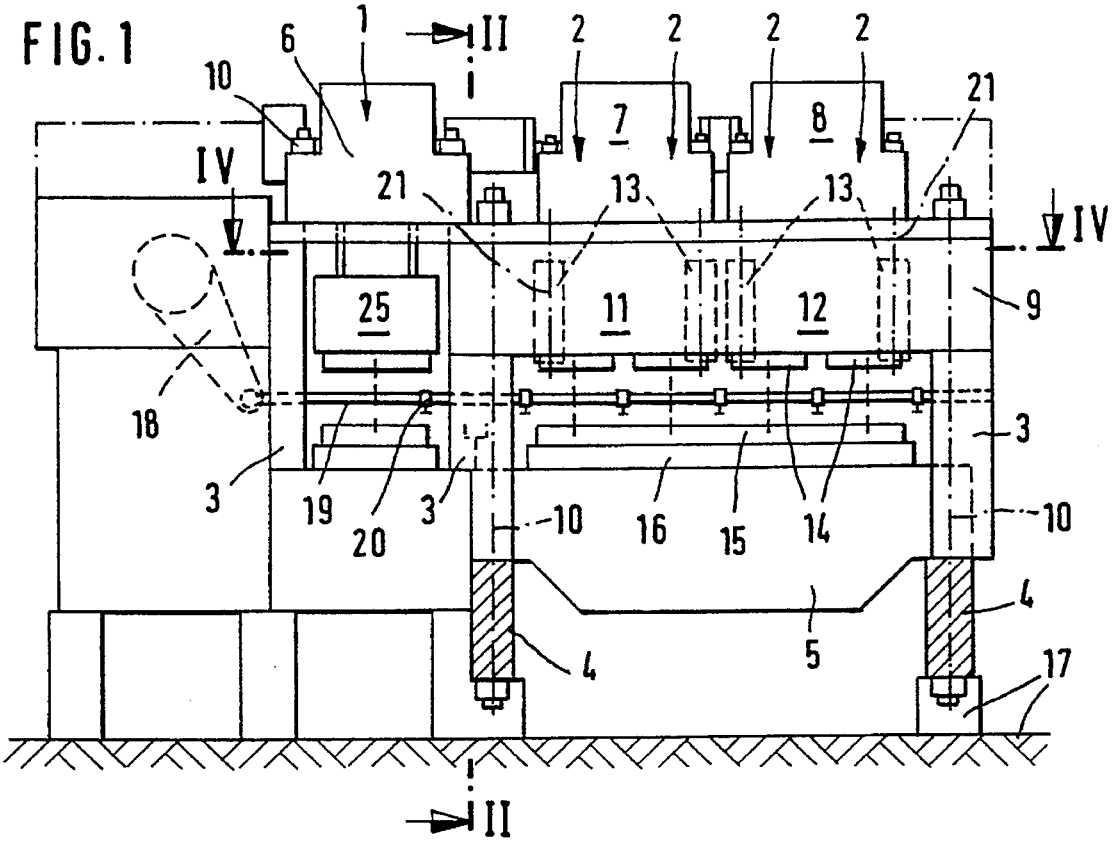
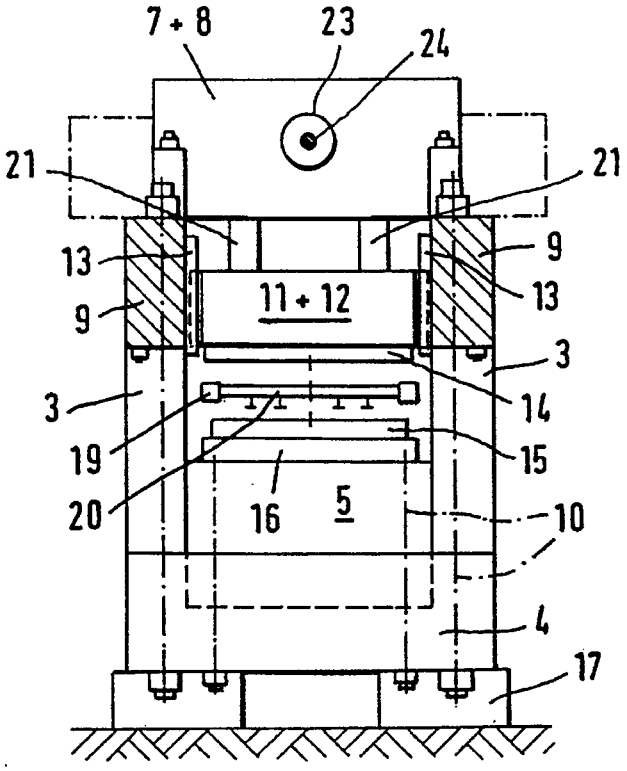
FIG. 2

PRESS INSTALLATION COMPRISING LONGITUDINAL TRAVERSES

BACKGROUND AND SUMMARY OF THE INVENTION

The present invention relates to a press installation having a drawing stage and working stages, and has a press frame having press supports, a press bed, headpieces, and turnbuckles that rigidly connect the press supports, the press bed and the headpieces with one another. Such a press installation also has slides for forming, a transfer device providing a transfer movement of workpieces between the working stages, and driving devices that provide a moving drive of the slides and the transfer device.

Press installations of this type are used for the farming of sheet metal parts in a first working stage constructed as a drawing stage and additional working stages which follow the drawing stage. The forming takes place by means of very high forces which are applied by the driving elements, are transmitted by the slides and the tool top parts to the sheet metal parts and tool bottom parts and the press bed and must be absorbed by the press frame as a whole. In addition, non-uniform changes in shape on the workpiece result in eccentric stresses on tools and slides.

It is known from German Patent Documents DE-31 43 690 C2 and DE-33 28 631 C2 to guide press slides on the press frames This is a measure which makes high demands on the guiding of the slides and the dimensioning of the press frames.

In the German Patent Document DE 33 22 377 C2, a press frame of a mechanically driven large-piece transfer press is described in which cross traverses are individual components of the press frames. Two headpieces exist for receiving the driving devices for two slides which are supported on press supports or their cross traverses as well as two press beds. The press is therefore not a uniform static whole. The slides can be moved up and down in the frame areas on the cross traverses in guides. The working area is interrupted by press supports.

In contrast to the above, an object of the present invention to provide a stable and compact and, on the whole, shorter press installation while press supports as well as intermediate depositing in the central working areas are omitted. Another object of the present invention is to provide a press in which the headpieces are supported on the two longitudinal traverses.

This and other objects are achieved by the present invention which provides a press installation having a drawing stage and working stages, comprising a press frame having press supports, a press bed, headpieces, and turnbuckles that rigidly connect the press supports, the press bed, and the headpieces with one another. The press installation also has slides for forming, a transfer device providing a transfer movement of workpieces between the working stages, and driving devices that provide a moving drive of the slides and the transfer device. A longitudinal traverse respectively extends in front of and behind the slides in the longitudinal dimension of the press installation, the longitudinal traverses each extending along the length of at least the working stages. One pair of the press supports is arranged behind the drawing stage and in front of the working stages, and another pair of the press supports is arranged behind the working stages, with one of the press supports being situated locally in front of the slides and another of the press supports being situated locally behind the slides, the longitudinal traverses being supported on the press supports and braced by the turnbuckles. Vertically extending guides are arranged on the longitudinal traverses, in which guides at least the slides of the working stages are disposed with complementary guides so that the slides are vertically moveable.

A special advantage of the present invention is the cost-effective design of the press installation while increasing the stability. This increased stability leads to a significant simplification of the drive in the transfer movement.

Other objects, advantages and novel features of the present invention will become apparent from the following detailed description of the invention when considered in conjunction with the accompanying drawings.

BRIEF DESCRIPTION OF THE DRAWINGS

FIG. 1 is a view of the overall construction of a press installation according to an embodiment of the present invention.

FIG. 2 is a lateral view corresponding to the course of the section II—II of FIG. 1.

DETAILED DESCRIPTION OF THE DRAWINGS

Figure 3:
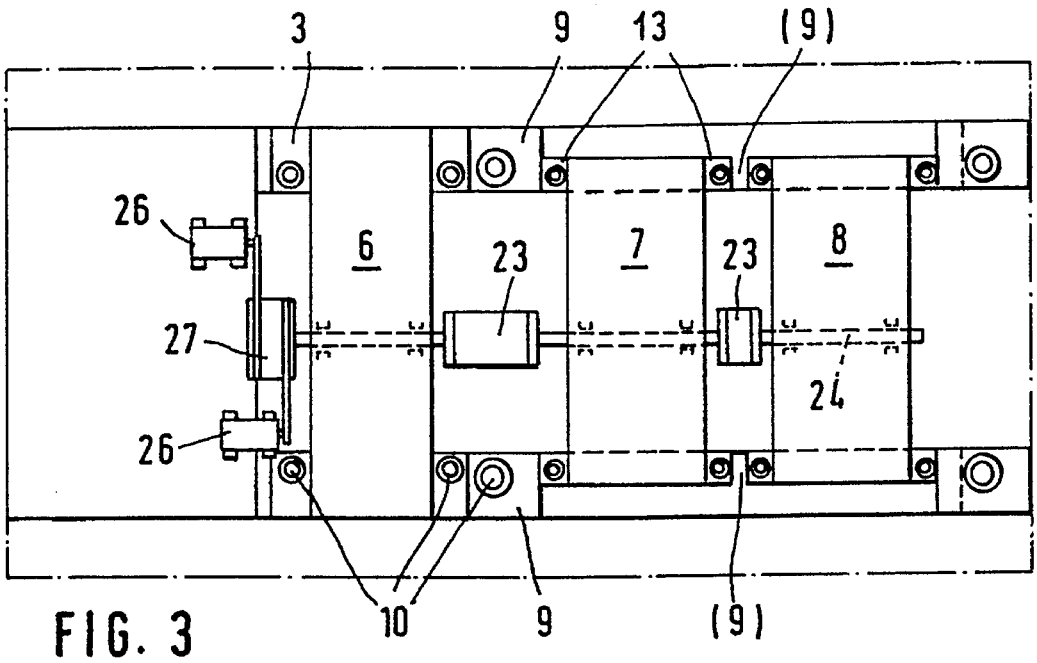
FIG. 3 is a top view of the press installation according to FIG. 1.

The press installation illustrated in the figures comprises a drawing stage 1 and working stages 2. Reference number 3 indicates the press supports which are set up via press cross traverses 4 on the foundation 17 of the press. The press bed 5 rests on the press cross traverses 4 which are situated in front of and behind the working stages 2, viewed in the longitudinal direction of the press. It is possible to place the press supports 3 on the press cross traverses 4 with the press bed 5 disposed in-between. Longitudinal traverses 9 are placed on the press supports 3. These longitudinal traverses 9 extend at least along the whole area of the working stages 2. One longitudinal traverse 9 is arranged in front of the slides 11, 12, and one longitudinal traverse 9 is arranged behind the slides 11, 12, relative to FIG. 1. The longitudinal traverses 9 may extend along the whole length of the press installation. Headpieces 7, 8 are placed on the longitudinal traverses 9; another headpiece 6 is assigned to the drawing stage 1. The placing of the headpieces 7, 8 and possibly also of the headpiece 6 leads to a significant improvement of the overall construction of the press installation, particularly with respect to the stability of the installation. The press cross traverses 4, the press supports 3, the press bed 5, the longitudinal traverses 9 and the headpieces 7, 8 are braced together to form a structural unit by means of turnbuckles 10.

Reference number 18 indicates an oscillating lever which moves the transfer device 19 with the grippers or suction devices 20 in the direction of a transfer movement for the sheet metal parts (workpieces). The slides 11, 12 and possibly also the slide 25, via guiding devices, which all have the reference number 13, are disposed so that they can be moved up and down on longitudinal traverses. On the slides 11, 12, the tool top parts 14 are disposed which interact with tool bottom parts 15 on a sliding table 16 which can be moved out of the press installation. The slides 11, 12 as well as 25 are suspended on connecting rods which together have the reference number 21 and are indicated as dash-dotted lines in FIG. 1.

Figure 4:
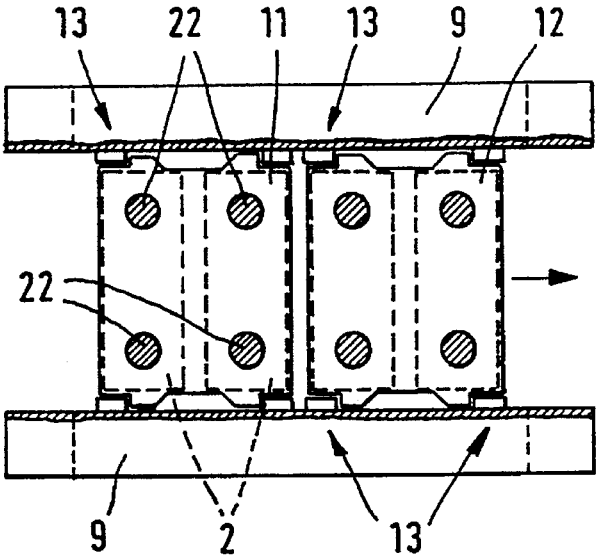
FIG. 4 is a sectional view according to the sectional course IV—IV in FIG. 1 with a view of the slide and the longitudinal traverses.

FIG. 4 illustrates the linking points 22 of the connecting rods 21 on the slides 11, 12. The connecting rods 21 can be driven by motors 26, a flywheel 27, a main shaft 24 and transmissions 23 installed in the headpieces. While FIGS. 1 to 3 show mainly the overall construction of the press installation, FIG. 4 shows the bearing of the slides 11, 12 on the longitudinal traverses 9 by means of the guides 13.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. A press installation having a drawing stage and working stages, comprising:

a press frame having press supports, a press bed, headpieces and turnbuckles that rigidly connect the press supports, the press bed and the headpieces with one another;

slides for forming;

a transfer device providing a transfer movement of workpieces between the working stages;

driving devices that provide a moving drive of the slides and the transfer device;

a longitudinal traverse respectively extending in front of and behind the slides in the longitudinal dimension of the press installation, the longitudinal traverses each extending along the length of at least the working stages;

wherein one pair of the press supports is arranged behind the drawing stage and in front of the working stages, and another pair of the press supports is arranged behind the working stages, with one of the press supports being situated locally in front of the slides and another of the press supports being situated locally behind the slides the longitudinal traverses being supported on the press supports and braced by the turnbuckles; and vertically extending guides arranged on the longitudinal traverses, in which guides at least the slides, of the working stages are disposed with complementary guides so that the slides are vertically moveable, further comprising:

a press cross traverse in front of the working stage which follows the drawing stage and another press cross traverse behind a last one of the working stages, the press cross traverses extend transversely with respect to a longitudinal dimension of the press installation;

a press bed which extends from one of the press cross traverses to the other press cross traverse and is placed on the press cross traverses;

wherein the press supports are supported directly on the press cross traverses with the press bed therebetween, the longitudinal traverses rest on the press supports, and at least two of the headpieces receive the driving devices for the slides, the headpieces resting on the longitudinal traverses.

* * * * *